US006679465B1

(12) United States Patent
Leasure

(10) Patent No.: US 6,679,465 B1
(45) Date of Patent: Jan. 20, 2004

(54) BOW REST

(76) Inventor: Richard L. Leasure, 11355 Backus Rd., Wattsburg, PA (US) 16442

( * ) Notice: Subject to any disclaimer, the term of this patent is extended or adjusted under 35 U.S.C. 154(b) by 0 days.

(21) Appl. No.: 10/334,389

(22) Filed: Dec. 31, 2002

(51) Int. Cl.[7] ..... E09F 7/18
(52) U.S. Cl. ..... 248/229.15; 124/23.1; 182/187
(58) Field of Search ..... 248/229.15, 229.24, 248/228.1, 228.6, 292.12, 220.21, 309.1; 124/23.1, 86, 88, 89; 182/92, 187

(56) References Cited

U.S. PATENT DOCUMENTS 5,723,808 A * 3/1998 Devall ..... 89/37.04
5,775,658 A * 7/1998 Englehardt ..... 248/309.1
5,967,475 A * 10/1999 Johnson ..... 248/217.4

OTHER PUBLICATIONS

Patent Application Publication No US 2001/0009158 A1 to O'Hare; publication date Jul. 26, 2001.*
Patent Application Publication No US 2002/0088163 A1 to Young et al.; publication date Jul. 11, 2002.*

* cited by examiner

*Primary Examiner*—Ramon O. Ramirez
(74) *Attorney, Agent, or Firm*—Richard K. Thomson

(57) ABSTRACT

A bow rest made of a high-strength, highly durable plastic, such as ABS, is attachable to a tree stand. A first member has a first ratchet surface that engages a second ratchet surface on a second member to permit rotational adjustment of the second member relative to the first member in an orientation to optimally engage and support a bow. The second member has a pair of support arms, one of which has an angled support surface designed to balance the weight of the bow. The support arms of the second member are jacketed with an elastomeric non-slip surface that is preferably made of rubber.

9 Claims, 4 Drawing Sheets

BOW REST

BACKGROUND AND SUMMARY OF THE INVENTION

The present invention is directed to the field of hunting accessories. More particularly, the present invention is directed to a bow rest for use in a tree stand, or the like.

Bow hunting is an increasingly popular sport, requiring significant skill and stealth. Tree stands can provide a certain level of creature comforts for a hunter out in the elements awaiting the quarry's approach. However, holding a high-powered bow at the ready can produce muscle fatigue that leads to an errant shot. On the other hand, lifting the bow from an at rest position, drawing the nocked arrow to a firing position, taking aim and firing will typically involve too much motion and potentially noise-producing movement to not spook the game.

Accordingly, a number of bow hunting accessories have been developed to assist the archer in being fully ready to engage the quarry when fortune delivers it to the doorstep of her/his tree stand. These accessories include an adjustable stop to hold the nocked arrow in the partially drawn position and bow rests for supporting a bow in an upright position. In fact, a number of bow rests have been developed and are being marketed. However, none of the available prior art devices have sufficient adjustability, durability and flexibility of use to warrant wide spread acceptance by hunters.

The bow rest of the present invention remedies the deficiencies of the prior art devices. The bow rest of the present invention comprises a first member, or base plate, with a first ratchet face on a first lateral face, attachment means for securing said first member to a portion of the tree stand, a second member with a second ratchet face on one of its lateral faces, the second ratchet face being engageable with the first ratchet face, the second member, or bow holder, having a pair of support arms extending outwardly from a second lateral face opposite said the lateral face of the second member, clamping means for securing said second ratchet face in rotationally adjustable contact with said first ratchet face, non-slip coating means covering at least portions of each of said pair of support arms; whereby said bow support is attached to a portion of the tree stand, said second member adjusted to a desired rotational position relative to said first member, and a bow inserted onto said support arms for retention in a desired posture. The first and second members are preferably made of a high strength, high durability plastic such as acrylonitrile-butadiene-styrene (ABS). The non-slip coating is preferably synthetic or natural rubber.

Various other features, advantages and characteristics will become apparent after a reading of the following specification.

BRIEF DESCRIPTION OF THE DRAWINGS

The preferred embodiment(s) of the present invention are set forth in the drawings, like items bearing like reference numerals and in which.

DETAILED DESCRIPTION OF THE PREFERRED EMBODIMENT(S)

Figure 1:
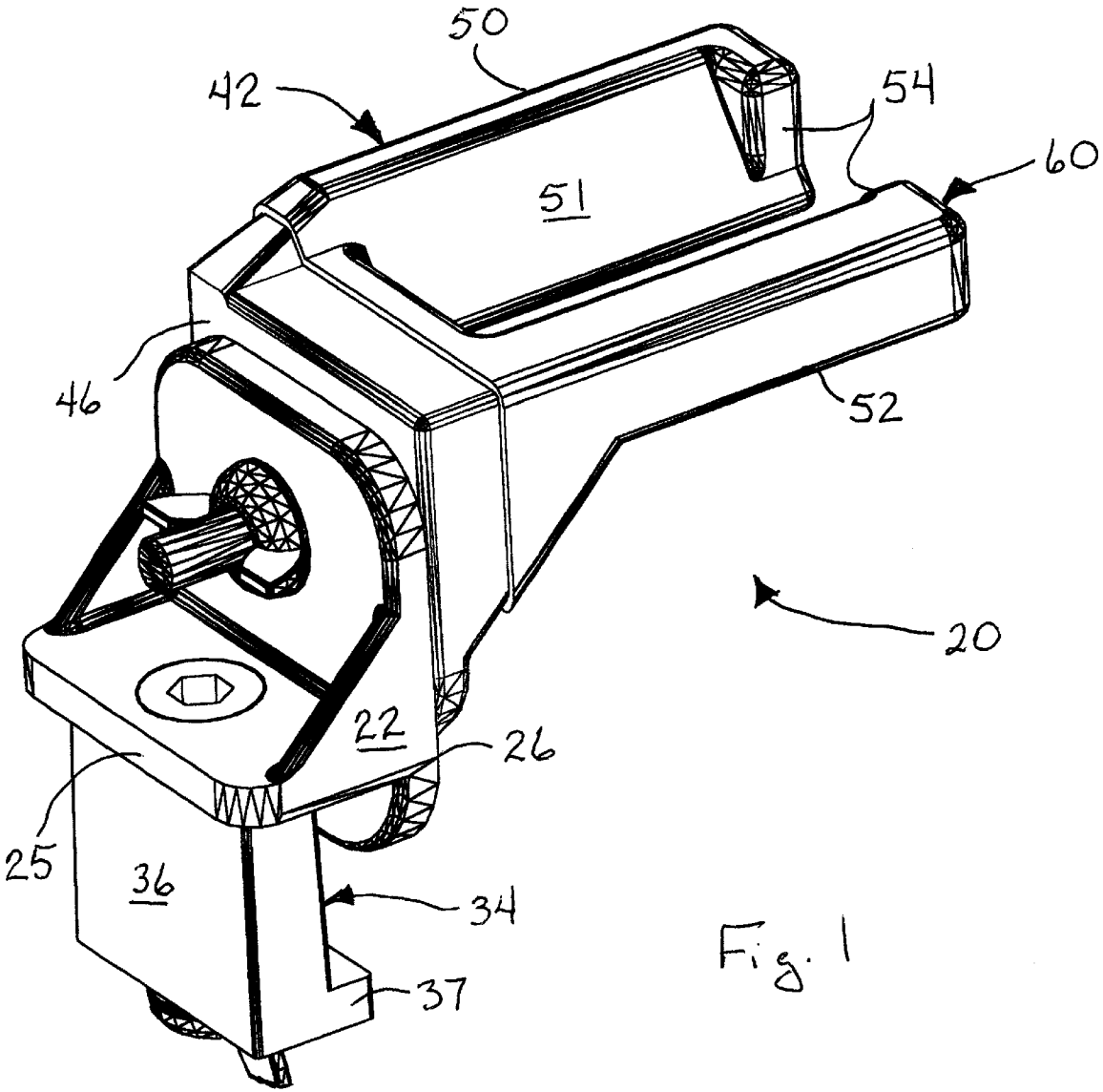
FIG. 1 is a right hand perspective view of a first embodiment of the bow rest of the present invention.
Figure 2:
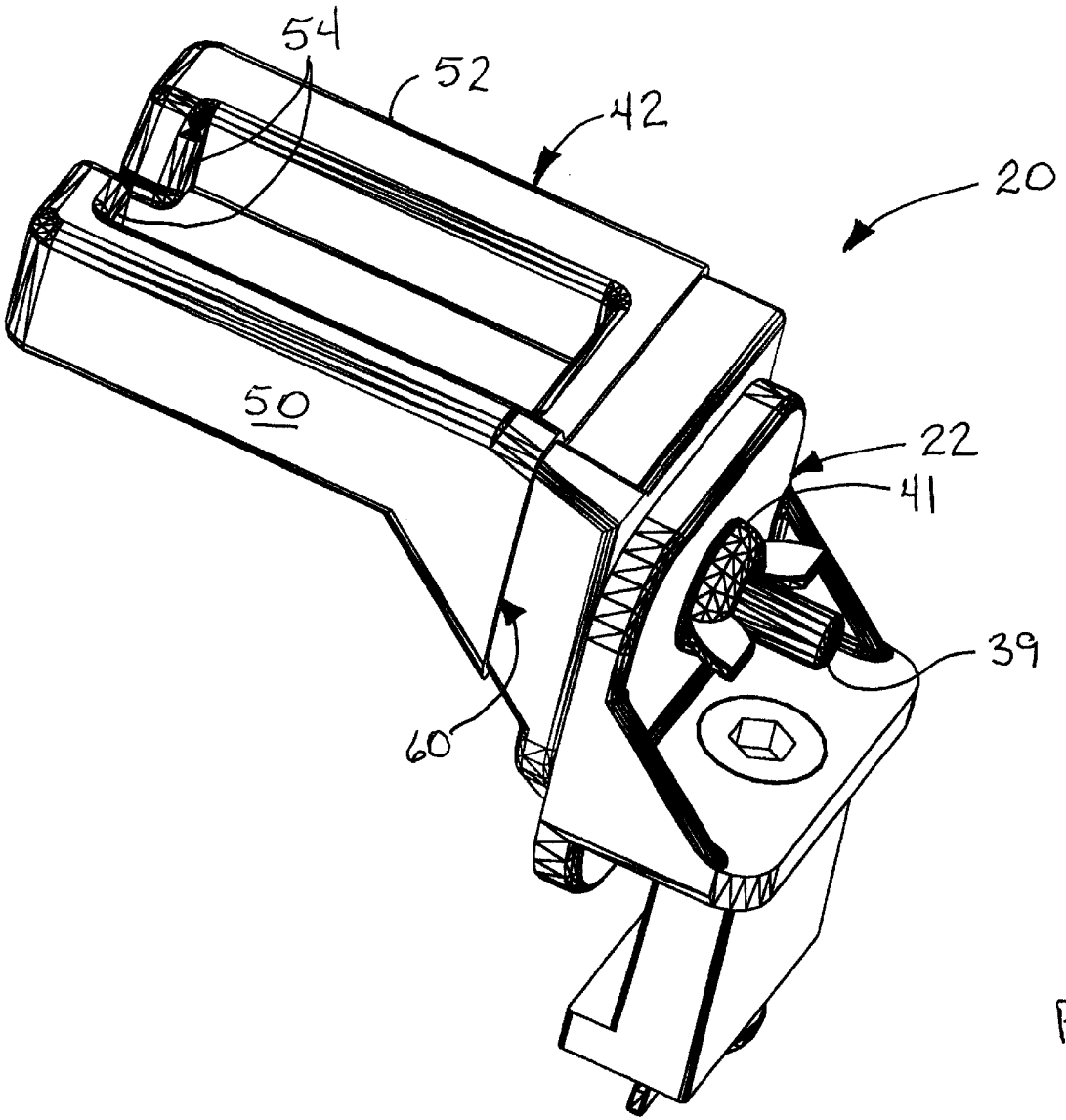
FIG. 2 is a left hand perspective view of the first embodiment.
Figure 3:
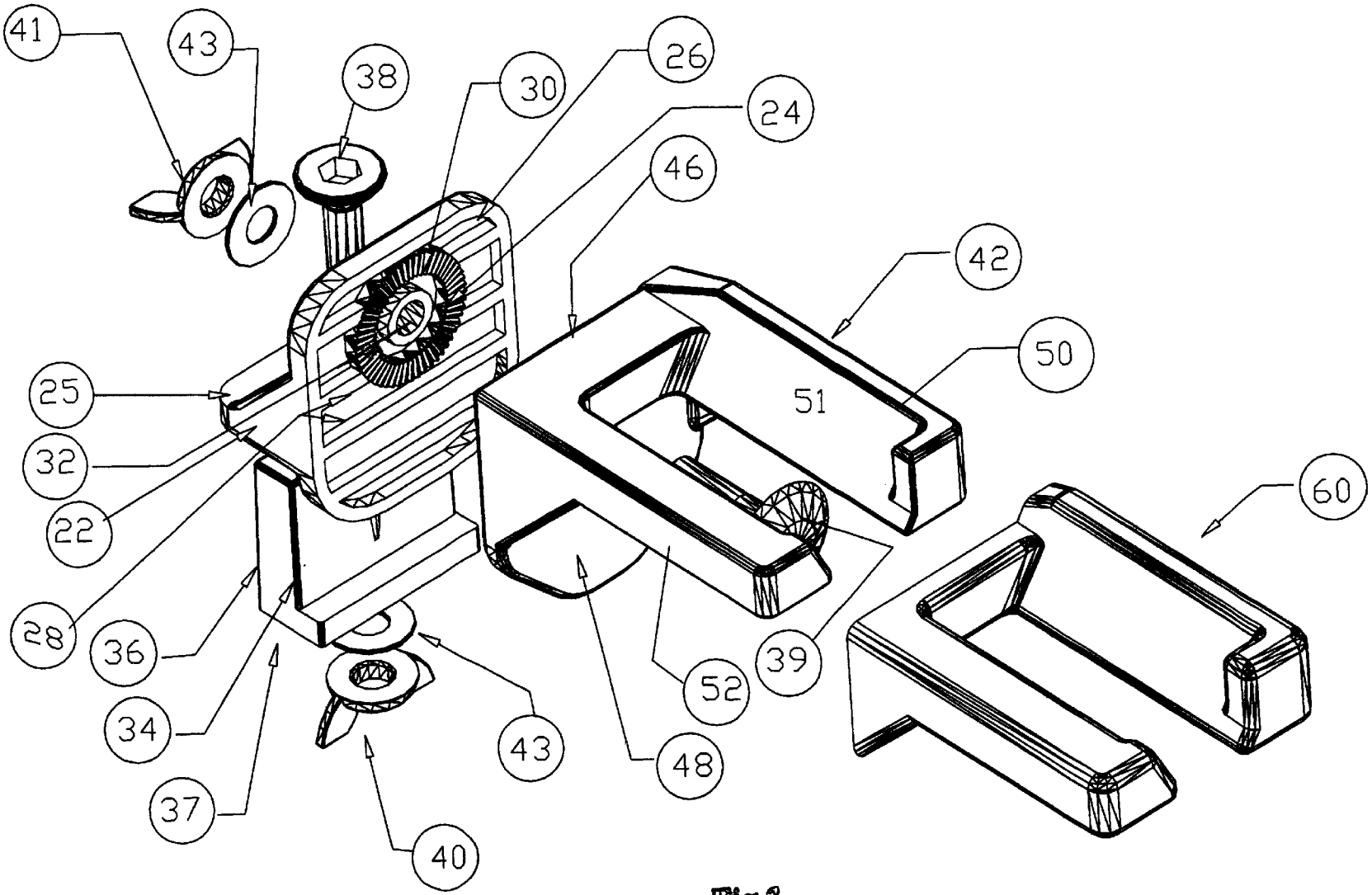
FIG. 3 is an exploded perspective view showing the details of the components in the first embodiment.
Figure 4:
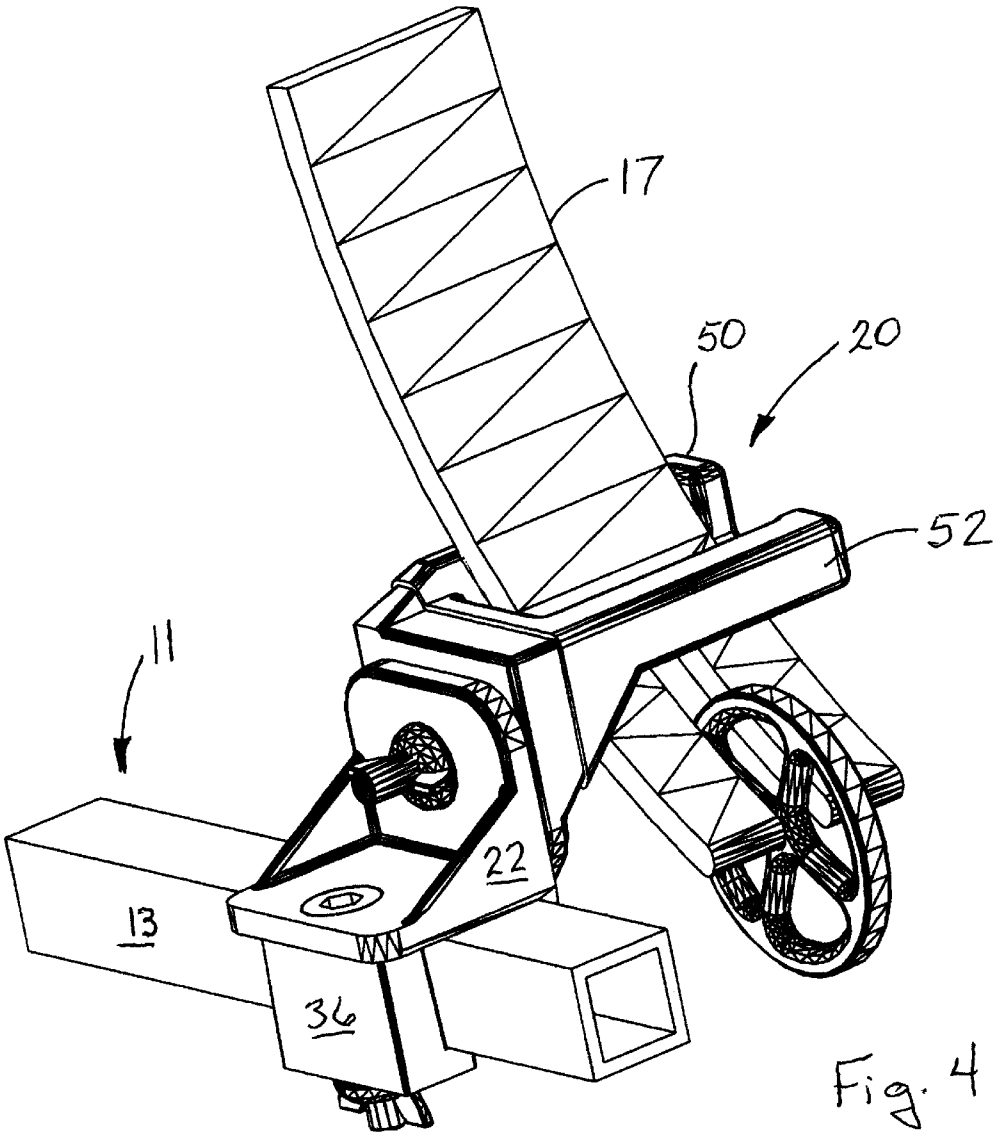
FIG. 4 is a perspective view showing the bow rest of the first embodiment shown attached to a tree stand and supporting a bow.

A first preferred embodiment of the bow rest of the present invention is shown in FIGS. 1–3 generally at 20. Bow rest 20 comprises a first member or base plate 22 with a first ratchet face 24 on first lateral face 26 (FIG. 3). Bow rest incorporates means 34 to attach it to a tree stand 11 (FIG. 4). Means 34, in this embodiment includes L-shaped arm 36 which clamps frame member 13 of tree stand 11 between laterally extending section 37 of L-shaped arm and flange 25 of first member 22 using bolt 38 and wing nut 40 with washer 43 reducing the risk of undesired loosening and distributes the clamping force of wing nut 40 over a larger surface. Obviously, other clamping means could be used, although this particular means has proven simple and reliable. Reinforcement ribs 28 provide structural stability while minimizing material usage. The material used to form the first and second members of the bow rest is a high-strength, highly durable plastic. While there are other suitable materials, acrylonitrile-butadiene-styrene (ABS) has proven itself to be suitable for this application. Ratchet face 24 surrounds collar 30 which itself surrounds and defines aperture 32 that receives a second bolt 39.

Second member or bow rest 42 has a second ratchet face (not shown) on first lateral face 46 which mates with first ratchet face 24, the ratchet face surrounding a square opening that engages a neck on the bolt 39 in a conventional manner, to prevent its rotation during securing and removal of wing nut 41. Washer 43 distribute the clamping force applied by wing nut 41 and the head of the bolt 39 over the surface of the mating ratchet faces preventing slippage. The opposing lateral face 48 of second member 42 has a pair of support arms 50 and 52 extending outwardly. Support arm 50 has a slanted support surface 51 upon which bow 15 can rest. Opposing arm 52 engages the bow 17 at a second point to retain bow 17 in an upright position. Each of the arms 50 and 52 have tangs 54 positioned at their outward extremities to prevent bow 15 from sliding off support arms 50, 52 should the bow rest 20 be canted as a result of the orientation of the tree stand 11. Support arms 50, 52 are coated with an elastomeric jacket 60 to provide slip resistance. Elastomeric jacket 60 is preferably either a natural or synthetic rubber.

In operation, base plate 22 of bow rest 20 is clamped to frame member 13 of tree stand 11 by loosening wing nut 40 placing laterally extending section 37 of L-shaped arm 36 on a side of member 13 opposite the side flange 25 occupies and tightening wing nut 40 on bolt 38. Typically, section 37 will engage the bottom surface of member 13 while flange 25 sits on its top surface. Wing nut 41 can be loosened on bolt 39 permitting second member 42 be rotated and adjustably positioned at an optimal position relative to first member 22. When the wing nut 41 is tightened, the two engaged ratchet surfaces will hold the support arms 50, 52 in the desired support position for the bow 17. Bow 17 can then be held by the bow rest 20 pending the approach of a quarry.

A number of changes, alternatives and modifications will become apparent after a reading of the foregoing specification. It is intended that all such changes, alternatives and modifications as fall within the scope of the appended claims be considered part of the present invention.

I claim:

1. A bow rest for use with a tree stand comprising a) a first member with a first ratchet face on a first lateral face thereof;

b) attachment means for securing said first member to a portion of the tree stand;

c) a second member with a second ratchet face on a first lateral face thereof, said second ratchet face being engageable with said first ratchet face to adjustably position said second member relative to said first member, said second member having a pair of support arms extending outwardly from a second lateral face opposite said first lateral face of said second member;

d) clamping means for securing said second ratchet face in rotationally adjustable contact with said first ratchet face;

e) non-slip coating means covering at least portions of each of said pair of support arms;

whereby said bow support is attached to a portion of the tree stand, said second member adjusted to a desired rotational position relative to said first member, and a bow inserted onto said support arms for retention in a desired posture.

2. The bow rest of claim 1 wherein said first member is comprised of a high strength, high durability plastic.

3. The bow rest of claim 2 wherein said second member is comprised of a high strength, high durability plastic.

4. The bow rest of claim 3 wherein said second member is comprised of the same high strength, high durability plastic as said first member.

5. The bow rest of claim 4 wherein said high strength, high durability plastic is ABS.

6. The bow rest of claim 5 wherein said non-slip coating means comprises rubber.

7. The bow rest of claim 1 wherein said non-slip coating means comprises rubber.

8. The bow rest of claim 1 wherein said attachment means comprises an L-shaped arm that bolts to said first member in an adjustable manner to clamp onto a support member of the tree stand.

9. The bow rest of claim 1 further comprising tangs formed on an outer end of each of said pair of support arms, said tangs extending inwardly toward each other to help secure a bow on said bow rest.

* * * * *